US011180977B2

(12) United States Patent
Harris et al.

(10) Patent No.: US 11,180,977 B2
(45) Date of Patent: Nov. 23, 2021

(54) PLUNGER LIFT METHOD

(71) Applicants: William Charles Harris, San Angelo, TX (US); Edward Alexander Wells, Montgomery, TX (US)

(72) Inventors: William Charles Harris, San Angelo, TX (US); Edward Alexander Wells, Montgomery, TX (US)

( * ) Notice: Subject to any disclaimer, the term of this patent is extended or adjusted under 35 U.S.C. 154(b) by 0 days.

(21) Appl. No.: 16/865,329

(22) Filed: May 2, 2020

(65) Prior Publication Data

US 2020/0318466 A1 Oct. 8, 2020

Related U.S. Application Data

(60) Continuation-in-part of application No. 16/220,256, filed on Dec. 14, 2018, now Pat. No. 10,641,072, which is a division of application No. 15/330,271, filed on Sep. 1, 2016, now Pat. No. 10,161,231.

(60) Provisional application No. 62/283,685, filed on Sep. 8, 2015.

(51) Int. Cl.
*E21B 43/12* (2006.01)
*F04B 47/12* (2006.01)

(52) U.S. Cl.
CPC ..... *E21B 43/121* (2013.01); *F04B 47/12* (2013.01)

(58) Field of Classification Search
CPC ..... E21B 43/121; E21B 34/08; E21B 37/10; E21B 43/12; E21B 43/122; E21B 33/068; F04B 47/12; F04B 31/00
See application file for complete search history.

(56) References Cited

U.S. PATENT DOCUMENTS

| | | | | |
|---|---|---|---|---|
| 2,001,012 | A * | 5/1935 | Burgher | E21B 43/121 417/60 |
| 2,661,024 | A * | 12/1953 | Knox | F04B 47/12 251/65 |
| 2,878,754 | A * | 3/1959 | McMurry | F04B 47/12 417/60 |
| 2,962,978 | A * | 12/1960 | Reeves | E21B 43/12 417/56 |
| 4,070,134 | A | 1/1978 | Gramling | |
| 4,712,981 | A | 12/1987 | Gramling | |
| 4,986,727 | A | 1/1991 | Blanton | |
| 5,333,684 | A | 8/1994 | Walter | |
| 6,148,923 | A | 11/2000 | Casey | |
| 6,209,637 | B1 | 4/2001 | Wells | |
| 6,467,541 | B1 | 10/2002 | Wells | |
| 6,637,510 | B2 | 10/2003 | Lee | |
| 6,719,060 | B1 | 4/2004 | Wells | |

(Continued)

FOREIGN PATENT DOCUMENTS

| | | |
|---|---|---|
| CA | 2504503 | 10/2005 |
| RU | 1756628 | 3/1990 |

*Primary Examiner* — Kipp C Wallace
(74) *Attorney, Agent, or Firm* — G. Turner Moller

(57) ABSTRACT

A plunger includes a sleeve having a passage therethrough and a valve member in the passage. When the plunger falls in a production string of a hydrocarbon well, the valve member is open and allows gas flow through the plunger. When the plunger contacts a liquid slug in the production string, the valve closes so that pressure from below reverses movement of the plunger so it pushes liquid above the plunger toward the earth's surface and ultimately to a well head where liquid and gas are separated.

21 Claims, 6 Drawing Sheets

(56) References Cited

U.S. PATENT DOCUMENTS

| | | | | |
|---|---|---|---|---|
| 6,725,916 | B2 * | 4/2004 | Gray | E21B 43/121 166/101 |
| 6,851,480 | B2 | 2/2005 | Swoyer | |
| 7,021,387 | B2 | 4/2006 | Lee | |
| 7,121,335 | B2 | 10/2006 | Townsend | |
| 7,134,503 | B2 | 11/2006 | Lee | |
| 7,383,878 | B1 * | 6/2008 | Victor | E21B 43/121 166/105 |
| 7,438,125 | B2 | 10/2008 | Victor | |
| 7,448,442 | B2 | 11/2008 | Wells | |
| 8,066,496 | B2 | 11/2011 | Brown | |
| 8,347,955 | B1 * | 1/2013 | Sewell | E21B 43/121 166/105 |
| 8,448,710 | B1 | 5/2013 | Stephens | |
| 9,863,218 | B2 * | 1/2018 | Farrow | E21B 37/00 |
| 9,869,165 | B2 | 1/2018 | Hightower | |
| 9,945,209 | B2 * | 4/2018 | Farrow | E21B 37/10 |
| 9,976,548 | B2 * | 5/2018 | Zimmerman, Jr. | E21B 43/121 |
| 2005/0241819 | A1 | 11/2005 | Victor | |
| 2010/0294507 | A1 * | 11/2010 | Tanton | F04B 47/12 166/372 |
| 2016/0108710 | A1 * | 4/2016 | Hightower | E21B 43/121 166/372 |

* cited by examiner

PLUNGER LIFT METHOD

This application is based on Provisional Patent Application 62/283,685 filed Sep. 8, 2015, priority of which is claimed and U.S. application Ser. No. 15/330,271, filed Sep. 1, 2016, now U.S. Pat. No. 10,161,231 issued Dec. 25, 2018, and is a continuation-in-part of U.S. application Ser. No. 16/220,256, now U.S. Pat. No. 10,641,072.

This invention relates to a plunger lift or free piston that is used to lift liquids from hydrocarbon wells.

BACKGROUND OF THE INVENTION

There are a variety of ways to artificially lift liquids from oil and gas wells. One of these is called a plunger or plunger lift which is commonly used to lift water, hydrocarbon liquid or a combination thereof from a gas well. The original plunger was a one piece piston. The well was shut in and the piston dropped into the well. When it reached the bottom, the well was opened so gas below the piston would push the piston and any liquid above it to the surface. More modern plungers are two piece affairs, i.e. a sleeve and a ball as shown in U.S. Pat. Nos. 6,467,541 and 6,719,060, the disclosures of which are incorporated herein by reference. When the sleeve and ball reach the surface, the sleeve passes onto a rod which dislodges the ball causing it to fall back into the well. The sleeve is held for a while at the surface and is usually dropped in response to a command from a controller. When the sleeve falls and reaches the bottom of the well, it meets up with the ball so gas from below pushes the sleeve and ball to the surface thereby removing some liquid from the well. The removal of liquid allows more gas to be produced from the well.

Two piece plunger lifts have been successful in prolonging the life of gas wells because they remove liquid during each cycle and do not require the well to be shut in. A problem with any artificial lift system is that wells do not act consistently, i.e. they produce only gas for a while, produce a lot of liquid for a while, produce both gas and liquid at varying rates, sometimes produce nothing at all and otherwise defy operation by a computer or controller.

Disclosures of some interest are found in U.S. Pat. Nos. 4,070,134; 4,712,981; 4,986,727; 6,637,510; 6,851,450; 7,021,387; 7,121,335; 7,134,503; 7,438,125; 7,784,549; Canada 2,504,503 and Russia 1,756,628.

SUMMARY OF THE INVENTION

The broad idea of this invention is to provide a plunger which reacts automatically in response to contacting a sizeable amount or contiguous body of liquid, such as at a gas/liquid interface, during its downward movement into a well and thereby reverse directions to push at least part of the liquid upwardly and out of the well. Accordingly, the plunger is capable of reversing direction and lifting part or all of a slug or pocket of liquid inside a production string below which is a gas bubble. This may occur substantially above the bottom of the well in contrast to normal plunger operation where the plunger or plunger parts fall to the bottom of the well. In all embodiments, a sleeve has therein a movable valve element which normally allows gas movement through the sleeve during downward movement of the sleeve into the well. When the plunger contacts a sizeable quantity or slug of liquid in the production string, the valve element moves to a position preventing flow through the sleeve whereupon the plunger reacts to a pressure from below, reverses movement and starts upwardly through the production string thereby delivering a quantity of liquid to the surface and then restarting downward movement into the well. In some embodiments, the valve is a ball closing against a seat in a passageway in the sleeve. In some embodiments, the valve is a ball closing against a seat near a lower end of the sleeve.

DETAILED DESCRIPTION OF THE INVENTION

Figure 1:
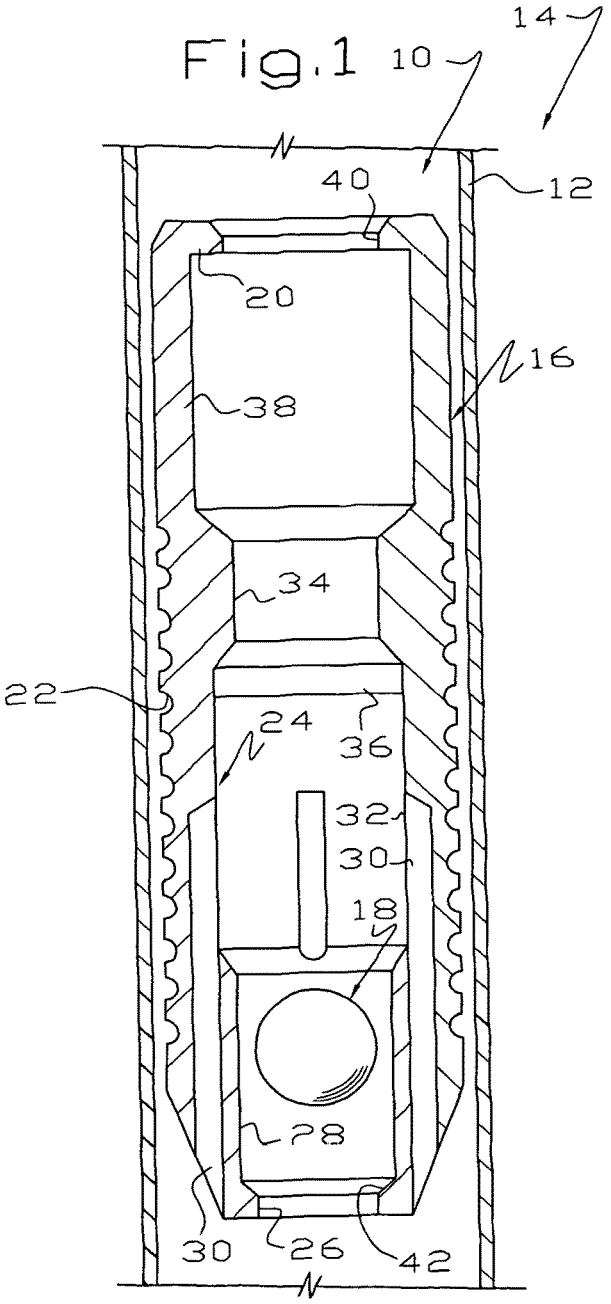
FIG. 1 is a cross-sectional view of one embodiment of a plunger showing normal downward movement of the plunger into a well.

As used herein, upper refers to that end of the plunger that is nearest the earth's surface, which in a vertical well would be the upper end but which in a horizontal well might be no more elevated than the opposite end. Similarly, lower refers to that end of the tool that is furthest from earth's surface. Although these terms may be thought to be somewhat misleading, they are more normal than the more correct terms proximal and distal ends.

Flow in a gas or oil well which is amenable to plunger operation is two phase flow, i.e. both liquids and gases are flowing upwardly in a production string. Two phase flow is difficult to calculate or predict. During stable flow, with a small amount of liquid, the liquid may be in the form of a mist entrained in the gas or a thin liquid film adhering to the interior of the production string. During stable flow, such a film moves upwardly at a moderate to low rate while gas flows at a much higher rate inboard of the liquid film. As the amount of liquid increases, there comes a point when the film detaches from the inside of the production string and falls as a slug or batch downwardly into the well. Liquid slugs are often separated by gas bubbles. The gas bubbles travel upwardly and push the liquid slugs upwardly until the gas breaks through the liquid and the liquid falls downwardly in the well until it reestablishes as a contiguous liquid body or slug. This process repeats until liquid is delivered to the surface or until the amount of liquid collects in a batch that is sufficient to kill the well.

This invention will be described in a vertical well although it should be understood that plungers operate satisfactorily in the vertical leg of horizontal wells. Typically, when a horizontal well transitions from generally vertical to more-or-less horizontal, there is a zone near or below this transition zone where plungers slow down and stop because gravity no longer operates to move the piston toward the end of the well. Movement of plungers into a well are normally stopped by a tubing stop or similar mechanism. In a vertical well, the tubing stop is normally some feet above perforations communicating between the production string and the hydrocarbon bearing formation from which gases and liquids are flowing into the production string. In a horizontal well, the tubing stop is normally located some feet above the transition from vertical to horizontal although its exact position is not material to the operation of the plunger described hereinafter. In some or all horizontal wells, there is no requirement for a tubing stop because, as the plunger falls through the transition zone between vertical and horizontal, it becomes much easier for the valves in the disclosed embodiments to close, stop and then reverse direction. Thus, in some or all horizontal wells, one may dispense with a tubing stop and rely upon the reversing action of the plungers. Although tubing stops are sturdy, reliable devices, one less device in a well means one less potential problem.

Figure 2:
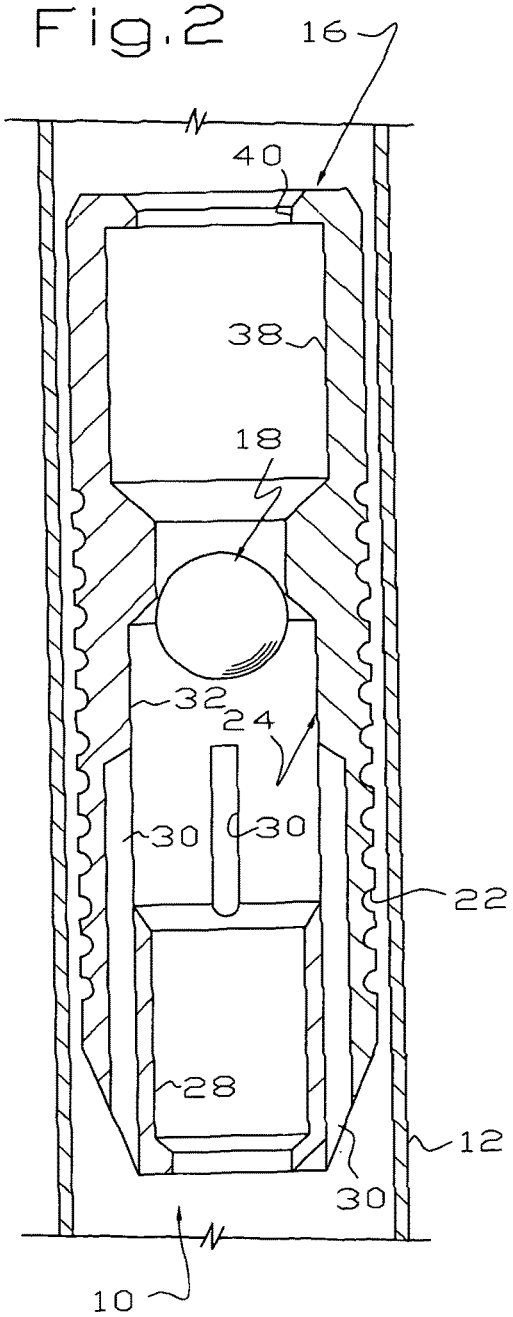
FIG. 2 is a cross-sectional view of the embodiment of FIG. 1 showing the plunger reacting to contact with a sizeable slug of liquid in the well and closing off upward flow through the sleeve.
Figure 3:
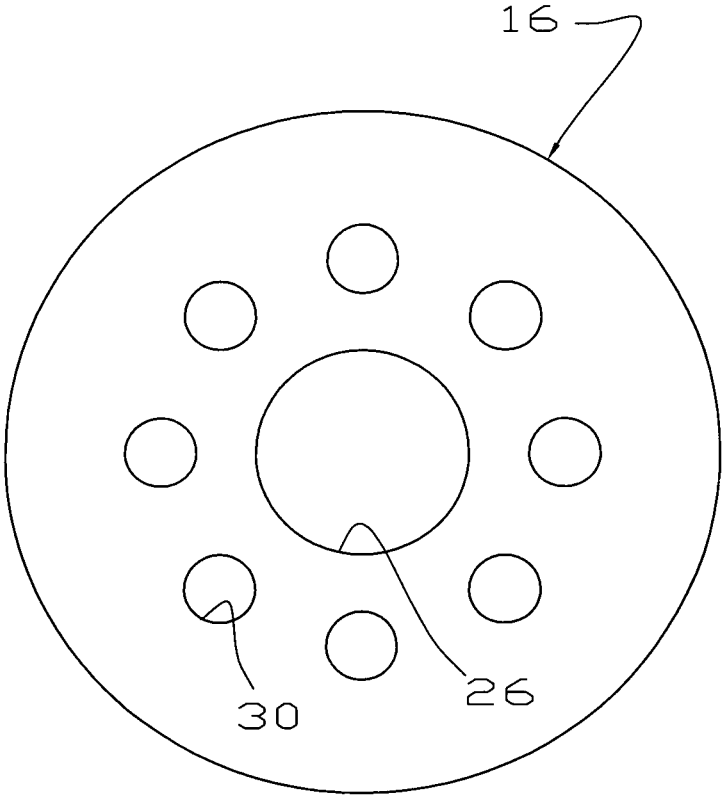
FIG. 3 is a bottom view of the embodiment of FIGS. 1 and 2.

Referring to FIGS. 1-3, one embodiment of a plunger 10 of this invention is shown as falling downwardly through a gas column in a production string 12 of a hydrocarbon well 14. The production string 12 may be tubing suspended inside casing or may be a pipe string cemented in the well bore comprising part of the well 14 as is well known in the art. The plunger 10 comprises, as major components, a sleeve 16 and a valve ball 18. The sleeve 16 may have an exterior fishing neck (not shown) or an interior fishing neck 20 to retrieve the plunger 10 if anything should go amiss. The exterior of the plunger 16 may be more-or-less conventional having a seal such as a series of grooves 22 or other devices, such as whiskers, spring biased pads and the like, to minimize bypass of produced gas and liquid around the exterior of the sleeve and the like.

The grooves 22 act as an imperfect seal and function by creating turbulence between the exterior of the sleeve 16 and the interior of the production string 12. The turbulence reduces bypass flow in the gap between the sleeve 16 and the production string 12. Although there are many different types of seals between plunger sleeves and pipe strings, all seals of commercially successful plungers are passive in nature in the sense they are not moved around by some mechanism inside the plunger.

The sleeve 16 also includes a through passage 24 of unusual configuration and may include a lower opening 26, an upwardly opening lower compartment or cup 28, a series of bypass passages 30 opening into a central chamber 32, a neck 34 providing a valve seat 36 intermediate the end of the sleeve 16 and an upper chamber 38 opening upwardly through an upper opening 40. It will be seen that the valve seat 36 is part of the passage 24. The sleeve 16 may be made in multiple sections which may be threaded together to allow insertion of the valve ball 18 in the passage 24 and to captivate the valve ball 18 in the passage 24.

A conventional plunger has two basic functions. First, it must push liquid above the plunger upwardly, in a more-or-less efficient manner, in the well during upward movement of the plunger. This is the primary purpose of plungers. Second, it must allow downward movement of the plunger through the production string in order to be ready to move upwardly in the next cycle to push a batch of liquid upwardly in the well. Plungers described hereinafter have a third function, i.e. reversing downward movement into upward movement upon contact with a contiguous body of liquid such as at a gas/liquid interface. This may occur near the bottom of a well when the plunger falls into a liquid collection in the bottom of the well or intermediate the ends of the production string when the plunger falls into a sizeable slug of liquid above a gas bubble.

The valve ball 18 is selected to be of sufficient size and density that gas flow upwardly through the sleeve 16, during downward movement of the plunger 16, is insufficient to raise the ball 18 into sealing engagement with the valve seat 36. This may be accomplished by the selection of a metal from which the ball 18 is made, the size of the ball, the range of gas flow expected from the well in which the plunger 10 is to be used and the relative sizes of the passages 26, 30 as will be explained more fully hereinafter. Relatively low flow wells may dictate the use of light weight aluminum alloys, midrange flow gas wells may suggest the use of iron alloys while relatively high rate gas wells may suggest the use of alloys of tungsten, cobalt, lead or other dense metals. The size of the ball 18 is also a controllable parameter because the volume of a ball increases with the third power of its diameter while the resistance of the ball to movement from fluid flow is not a function of the cube of the ball diameter but is a function of the area exposed to an operating pressure which is normally proportional to the square of the diameter.

Another controllable variable in the design of the sleeve 16 is the relative flow capacity of the bypass passages 30 to the flow capacity of the lower opening 26. It is apparent that a lower opening 26 of maximum size and flow capacity is more apt to raise the ball 18 than a combination of a smaller sized opening 26 and larger passages 30. Conversely minimizing the size of the lower opening 26 can be used to make the bypass passages 30 larger and thereby decrease the tendency of normal gas flow through the plunger 10 to raise the ball 18.

In use, the plunger 10 is dropped from a well head (not shown) connected to the production string 12. So long as the plunger 10 is falling through gas, the ball 18 tends to remain in the lower compartment or cup 28 because gas flow through the opening 26 is not sufficient to raise the ball 18 to the valve seat 36. The valve seat 36 is illustrated as being conical providing a circular contact between the valve ball 18 and the valve seat 36. In this situation, the area exposed to pressure from below is the same as the area exposed to pressure from above, meaning the difference in upward and downward forces applied to the ball 18 is a function of pressure differential across the ball 18 because the areas are equal. Under some circumstances, the valve seat 36 may be hemispherical or partly hemispherical to change the area exposed to pressure from below and thereby modify the forces acting on the ball 18. Hemispherical or partly hemispherical is defined to mean that the valve seat 36 may have essentially the same radius of curvature as the valve ball 18. This concept is discussed more fully in conjunction with the embodiment of FIGS. 8-9. The ball 18 may or may not be selected to seal against a seat 42.

In any event, gas flowing through the passages 30 bypasses the ball 18, does not impinge on the ball 18 and thus produces no force tending to move it. The gas flow necessary to move the ball 18 upwardly out of the chamber 28 is controlled by the size and density of the ball 18, the size of the opening 26 and the size of the bypass passages 30. There may be some pressure drop across the ball 18 caused by flow through the bypass passages 30 providing a lift on the ball 18 and there may be a downward force on the ball 18 when it attempts to enter the area of turbulent flow in the chamber 32. During fall through gas, the force acting on the ball 18 may include the momentum of gas particles striking the ball 18 and the pressure differential between the upstream and downstream ends of the ball 18.

Wells in which the plunger 10 is selected to be used produce a quantity of water, liquid hydrocarbons or a combination thereof. Thus, the plunger 10 may strike a sizeable quantity of liquid in the production string 12 in the form of a slug or pocket of liquid at the bottom of the well or above the bottom of the well and substantially above the perforations through which formation fluids move. Upon impacting a contiguous body of liquid, resistance of the liquid to movement forces the ball 18 upwardly until it abuts the valve seat 36. From another viewpoint, the ball 18 is free to move when the sleeve 16 strikes a contiguous body of liquid and is accordingly driven by the impact to seal against the valve seat 36. In one sense, the valve ball 18 acts as a sensor to detect a liquid slug in the production string and thereby closes in response to the liquid slug.

With the well flowing at a minimum rate, flow maintains the ball 18 seated against the valve seat 36 thereby propelling the plunger 10 upwardly in the production string 12 thereby pushing liquid above the plunger 10 upwardly to the surface of the well 14.

If there is no sizeable quantity of liquid in the production string 12 substantially above perforations, the plunger 10 falls into the bottom of the well where a substantial quantity of liquid accumulates. After falling some interval into the liquid, the ball 18 reacts against the liquid to rise and seat against the valve seat 36 in the same manner as the valve ball 18 moves when impacting a liquid slug at a location intermediate the ends of the production string and well above the bottom of the well. Without being bound by any theory of operation, the ball 18 may react by buoyancy to abut the seat 36, may react by the resistance of liquid in the well 14 to the fall of the ball 18 or any other cause. In any event, the plunger 10 works satisfactorily when contacting a liquid slug or gas/liquid interface substantially above the bottom of the production string or near the bottom of the production string so the ball abuts the seat 36.

If the well 14 were completely dead, i.e. not flowing at all, the ball 18 would ultimately sink in the liquid and fall away from the valve seat 36 and come to rest in the lower compartment 28 and the plunger 10 would come to rest at the bottom of the well. However, no plunger is operative with a completely dead well so this is not a disadvantage peculiar to this embodiment.

During upward movement of the plunger 10 in the production string 12, the force created by pressure from below may exceed the force created by pressure from above which is partly the hydrostatic weight of the liquid column and partly the gas pressure above the liquid column. This keeps the ball 18 sealed against the seat 36. This sounds like a formidable disadvantage but no plunger can move upwardly if the load of liquid above the plunger creates a pressure greater than pressure below the plunger. Accordingly, so long as forces created by pressure from below exceeds forces created by the liquid load above the plunger, the plunger 10 rises to the surface where it may be captured for release after a delay or immediately released for more-or-less continuous cycling. Typically, the plunger 10 rises into a wellhead (not shown) and ultimately comes to rest in a compartment through which there is no flow. Because there is no flow around the valve ball 18, there is no pressure differential acting on the valve ball 18 so it unseats from the seat 36 and falls by gravity into the chamber 28 and can accordingly be dropped into the production string 12 so cycling resumes.

It will be seen that the valve ball 18 is the only moving element in the passage 24 that is operative to modify operation of the plunger 10.

Figure 4:
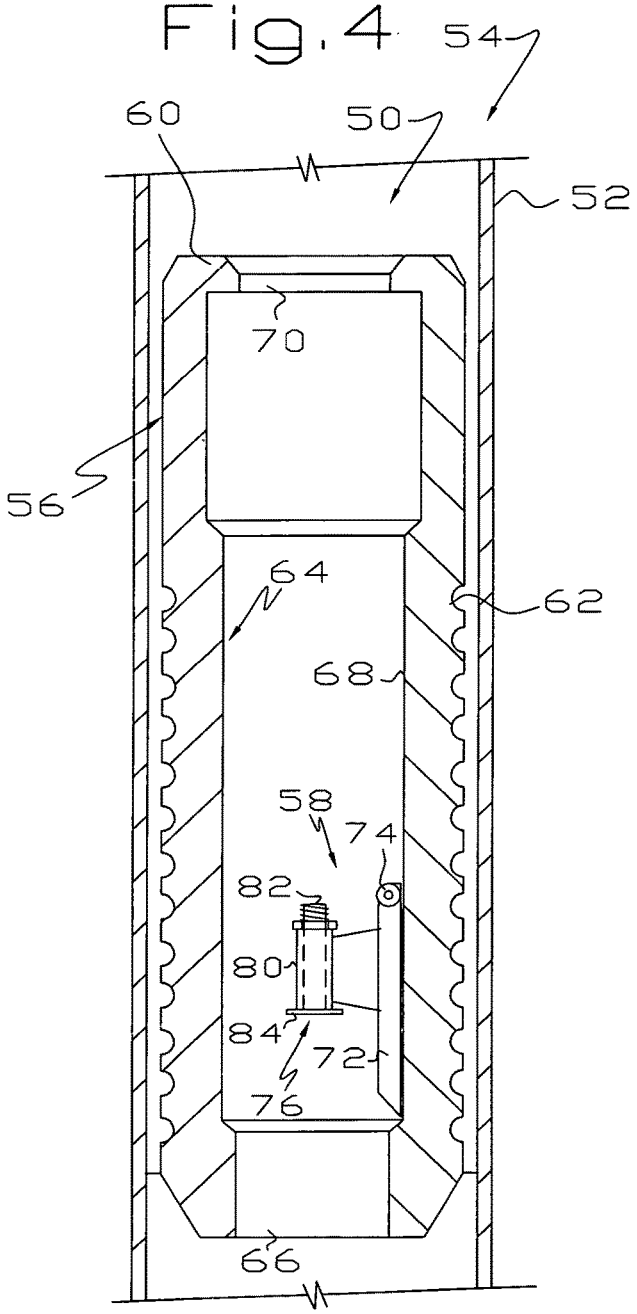
FIG. 4 is a cross-sectional view of another embodiment of a plunger showing normal downward movement of the plunger into a well.
Figure 5:
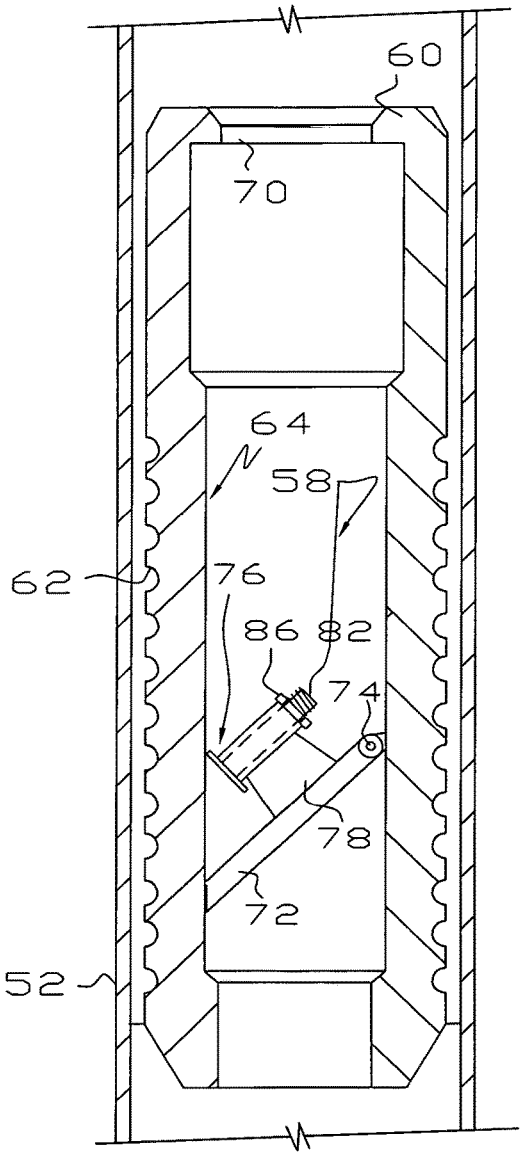
FIG. 5 is a cross-sectional view of the embodiment of FIG. 4 showing the plunger reacting to contact with a sizeable slug of liquid in the well.

Referring to FIGS. 4-5, there is shown another embodiment of a plunger 50 operating inside a production string 52 of a hydrocarbon well 54. The plunger 50 comprises, as major components, a sleeve 56 and a valve 58. The plunger 50 acts similarly to the plunger 10 in the sense that it falls inside the production string 52 at modest to high rates because gas travels unimpeded through it until the sleeve 56 strikes a sizeable quantity of liquid whereupon the valve 58 closes so any gas below the plunger 50 drives the plunger 50 upwardly thereby carrying liquid above the plunger 50 to the surface.

The sleeve 56 may have an external fishing neck or an internal fishing neck 60 and some device to minimize bypass around the exterior of the sleeve, such as grooves 62. The interior of the sleeve 56 is much simpler than in the embodiment of FIGS. 1-3 and includes a through passage 64 having a lower opening 66, a central chamber 68 and an upper opening 70.

The valve 58 may be of any convenient type and is illustrated as a flapper valve having a flapper plate 72 secured to the sleeve 56 by a pivot or hinge 74. A striker plate 76 is part of the flapper valve and is affixed to the flapper plate 72 and reacts to an impact against liquid in the production string 52 to close the flapper 72 against a valve seat provided by the central chamber 64. The striker plate 76 may include a strut 78 integral with the flapper 72 having a tubular end 80 through which extends a threaded fastener 82 having one end 84 exposed toward the source of formation fluids and a nut 86 securing the striker plate 74 to the flapper 72.

It will be seen the plunger 50 operates during downward movement in the well in much the same manner as the plunger 10. When dropped into a rising stream of gas, the weight of the striker plate 76 is sufficient to keep the flapper 72 out of the main stream of gas flow so gas flow is mainly unimpeded. When the plunger 50 falls into a sizeable body of liquid, either at the bottom of the well 54 or a liquid pocket in the production string 52, the striker plate 76 impacts against the liquid thereby moving the flapper 72 from the open position of FIG. 4 to the closed or partially closed position of FIG. 5. In one sense, the striker plate 76 acts as a sensor to detect a liquid slug in the production string and thereby closes the flapper 76 in response to the liquid slug.

When the plunger 50 reaches the bottom of the well during downward movement, there will almost always be liquid accumulated in response to normal operation of the well. In this circumstance, impact of liquid against the striker plate 76 causes the flapper valve 72 to close so that gas below the plunger 50 moves the plunger 50 upwardly to push liquid above the plunger 50 toward the surface of the earth to be disposed of in a conventional manner. It will be seen that pressure from below acts on the surface area of the ball 18 that corresponds to the area of the passage 34 which is also the area that pressure from above acts on the ball 18. Because these areas are equal in the case of the ball 18, so long as pressure from below exceeds pressure from above, the ball 18 remains on the seat 36 and pushes the plunger 10 upwardly. It will be seen that the plunger 50 acts essentially in the same manner as the plunger 10. Accordingly, so long as forces created by pressure from below exceeds forces created by the liquid load above the plunger, the plunger 50 rises to the surface where it may be captured for release after a delay or immediately released for more-or-less continuous cycling. Typically, the plunger 50 rises into a wellhead (not shown) and ultimately comes to rest in a compartment through which there is no flow. Because there is no flow around the flapper valve 58, the flapper valve 58 unseats from the passage wall 64 and falls by gravity into the position shown in FIG. 4 and can accordingly be dropped into the production string 12 so cycling resumes.

It will be seen that the flapper valve is the only moving element in the passage 64 that is operative to modify operation of the plunger 50.

Figure 6:
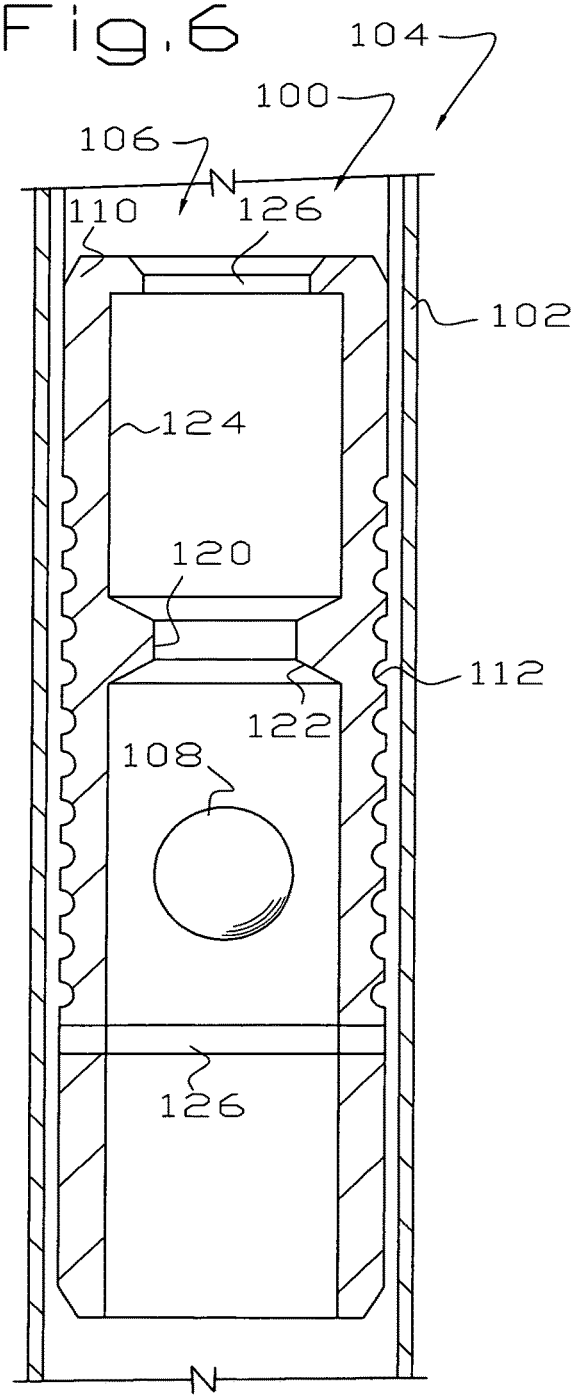
FIG. 6 is a cross-sectional view of another plunger showing normal downward movement of the plunger into a well.
Figure 7:
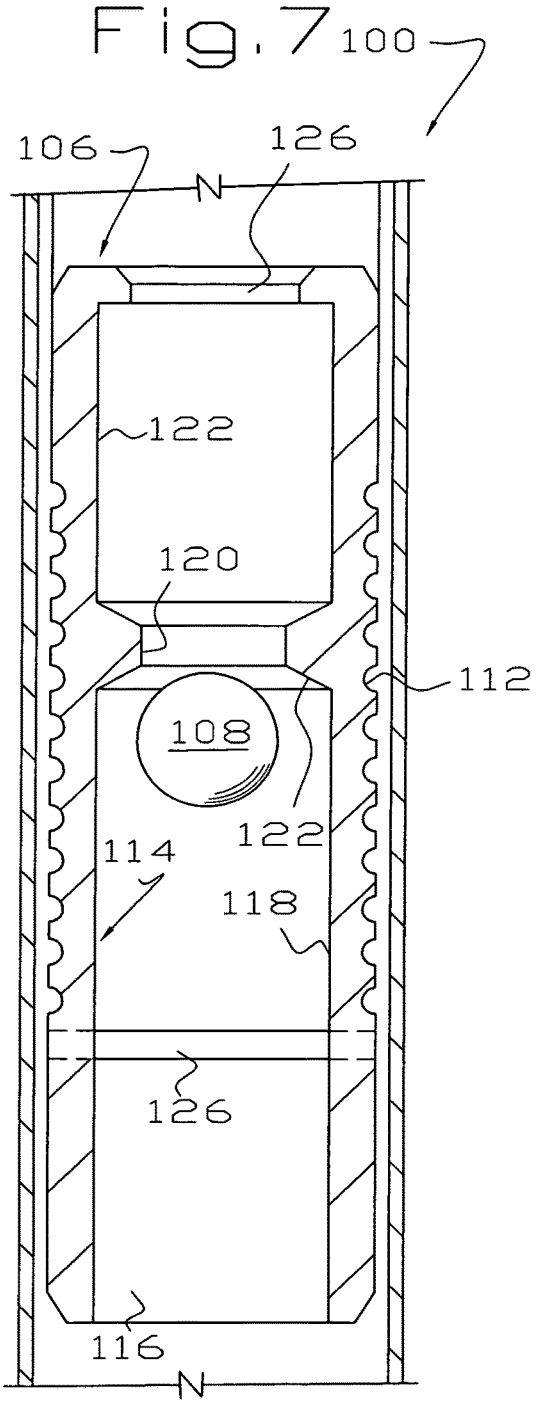
FIG. 7 is a cross-sectional view of the embodiment of FIG. 6 showing the plunger reacting to contact with a sizeable slug of liquid in the well.

Referring to FIGS. 6-7, there is shown another embodiment of a plunger 100 operating inside a production string 102 of a hydrocarbon well 104. The plunger 100 comprises, as major components, a sleeve 106 and a valve ball 108. The valve ball 108 tends to be smaller than the valve ball 18 for purposes more fully apparent hereinafter.

The sleeve 106 may have an external fishing neck (not shown) or an internal fishing neck 110 and some device to minimize bypass around the exterior of the sleeve, such as grooves 112. The interior of the sleeve 106 is much simpler than in the embodiment of FIGS. 1-3 and includes a through passage 114 having a lower opening 116, a central chamber 118, a neck 120 providing a valve seat 122 which may be conical as illustrated or hemispherical or partly hemispherical as discussed with the embodiment of FIGS. 1-3, an upper chamber 124 and an upper opening 126. The lower end of the sleeve 106 may be completely open, i.e. the lower opening 116 may be essentially the same size as the chamber 118 so there is no valve seat on the bottom of the sleeve 106. Instead of making the sleeve 106 into two pieces in order to retain the valve ball 108, a pin 128 may be provided to prevent the ball 108 from falling out of the bottom of the sleeve 106. The sleeve 106 may accordingly be of a simple one-piece construction and the ball 108 may be changed simply by removing the pin 128, replacing the ball 108 and reinstalling a pin 128.

The plunger 100 acts similarly to the plungers 10, 50 during downward movement of the plunger 100 in the sense that it falls inside the production string 102 at modest to high rates because gas travels relatively unimpeded between the exterior of the ball 108 and the interior of the chamber 118. The velocity of gas flowing through the plunger 100 is not sufficient to raise the valve ball 108 against the seat 122. When the sleeve 106 strikes or impacts a sizeable quantity of liquid, the valve ball 108 closes against the seat 122 so pressure below the plunger 100 reverses movement of the plunger 100 and drives the plunger 100 upwardly thereby carrying liquid above the plunger 100 to the surface. It will accordingly be seen that the plunger 100 operates in much the same manner as the plungers 10, 50 during downward movement of the plunger 100 in the sense that gas flow around the valve elements 18, 58, 108 does not actuate the valve and the valve elements 18, 58, 108 close upon contacting a contiguous body of liquid.

It will be seen that the sleeve 106 may be greatly simplified because the ball 108 does not seat at the lower end of the sleeve 106 and that flow around the ball 108 simply flows around the pin 128. It will accordingly be seen the valve ball 108 is designed so that normal gas flow through the passage 114 is insufficient to force the ball 108 into sealing engagement with the valve seat 122. However, when the plunger 100 contacts or impacts a sizeable amount of liquid in the production string 102, the valve ball 108 moves into at least partial sealing engagement with the valve seat 122 so that pressure below the plunger 100 drives the plunger 100 upwardly. This propels liquid above the plunger 100 to the surface where it is unloaded, allowing the plunger 100 to again fall into the well 104. It will accordingly be seen that operation of the plunger 100 is very similar to operation of the plungers 10, 50 in the sense that impacting a slug of liquid in the production string causes a valve in the plunger to close thereby allowing pressure from below to move the plunger upwardly and thereby unload liquid from the production string. Similarly, so long as forces created by pressure from below exceeds forces created by the liquid load above the plunger, the plunger 100 rises to the surface where it may be captured for release after a delay or immediately released for more-or-less continuous cycling. Typically, the plunger 100 rises into a wellhead (not shown) and ultimately comes to rest in a compartment through which there is no flow. Because there is no flow around the valve ball 108, the valve ball 108 unseats from the seat 122 and falls by gravity onto the pin 128 and can accordingly be dropped into the production string 102 so cycling resumes.

During upward movement of the plunger 100, pressure from below creates a force acting on the valve ball 108 to seal it against the seat 122 thereby pushing liquid above the plunger 100 upwardly toward earth's surface.

It will be seen that the valve ball 108 is the only operative moving element in the passage 114.

Figure 8:
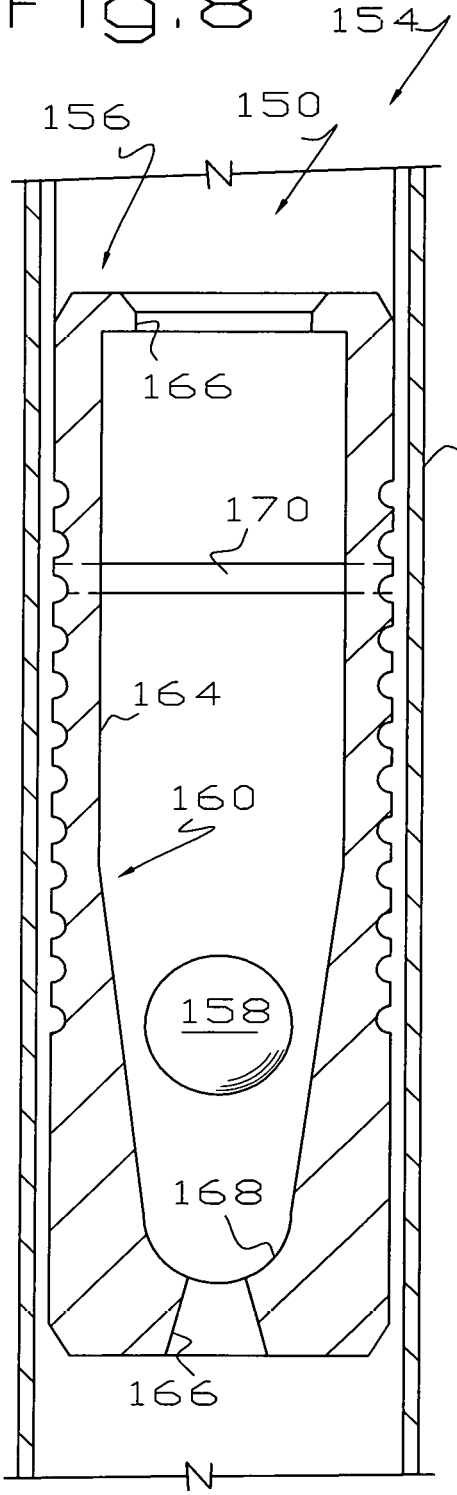
FIG. 8 is a cross-sectional view of another plunger showing normal downward movement of the plunger into a well.
Figure 9:
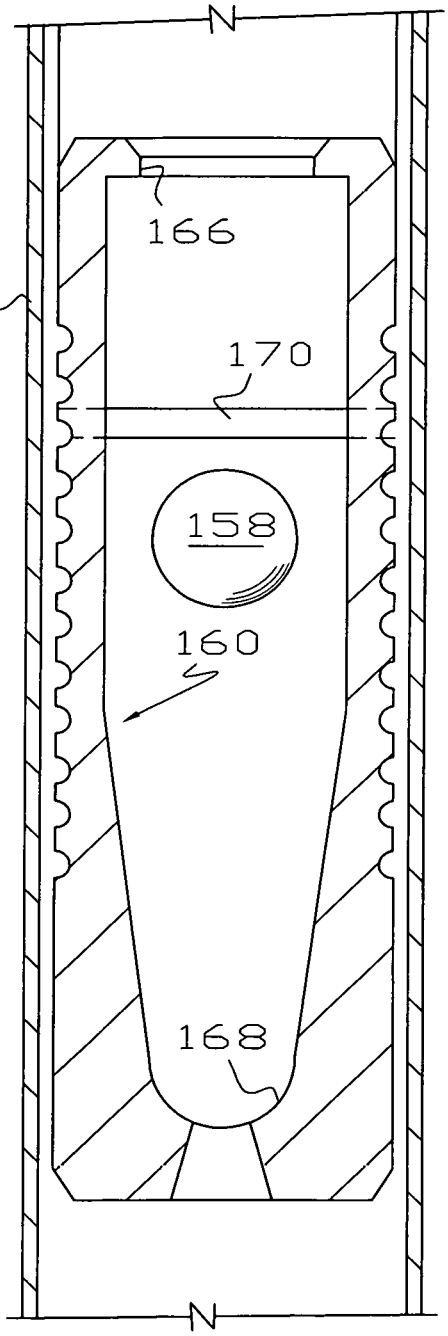
FIG. 9 is a cross-sectional view of the embodiment of FIG. 8 showing the plunger reacting to contact with a sizeable slug of liquid in the well.

Referring to FIGS. 8-9, there is shown another embodiment of a plunger 150 operating inside a production string 152 of a hydrocarbon well 154. The plunger 150 comprises, as major components, a sleeve 156 and a valve ball 158. The plunger 150 acts somewhat differently than the plungers 10, 50, 100 as explained more fully hereinafter although it functions to fall freely through a gas column in the production string 152 and reverses direction in response to impacting a liquid slug in the production string 152 as more fully explained hereinafter.

The exterior of the sleeve 156 is more-or-less conventional as in the plungers 10, 50, 100 and may include an internal or external fishing neck (not shown). The interior of the sleeve 156 includes a through passage 160 having a lower opening 162, a central chamber 164 and an upper opening 166. A lower portion of the chamber 164 includes a valve seat 168. It will be seen that the valve seat 168 has the same curvature or radius as the ball 158. This creates a difference in the area of the ball 158 that is exposed to pressure from above as contrasted to the area of the ball 158 that is exposed to pressure from below at a time when the ball 158 is flush against the valve seat 168. With the ball 158 flush against the seat 168, the area of the ball 158 exposed to pressure from above is the area of a circle having a diameter of the ball 158 while pressure from below operates only on an area of the ball 158 equal to the minimum area of the opening 162. A pin 170 extends across the chamber 164 at a location below the upper opening 166 to captivate the valve ball 158 in the passage 160.

The size and density of the valve ball 158 are subject to considerable variation and, together, produce an effect on the tendency of gas flowing through the plunger 150 to keep the valve ball 158 off the valve seat 168 during downward movement of the plunger 150 in the production string 152. The upward force on the valve ball 158 is mainly due to the pressure drop across the ball 158 as a result of gas flowing upwardly, i.e. there is a greater pressure on the underside of the ball 158 than on the top. The larger the valve ball 158, the smaller will be the gap between the ball 158 and the passage 160 and the greater the pressure drop across the ball 158. When the gap between the ball 158 and the passage 160 produces a large force, the density of the ball 158 may be increased to balance upward and downward forces to produce an operative device. In the embodiment illustrated in FIGS. 8-9, a ball 158 of the same size as the ball 18 would be more dense than the ball 18 in FIGS. 1-2 because more gas is acting on the ball 158 and thereby producing a greater force that would have to be counteracted by a heavier ball. The valve ball 158 is illustrated in FIGS. 8-9 as being of the same diameter as the valve ball 18 and is accordingly selected from a more dense material.

If it is desirable that the ball 158 be heavier than steel so an alloy of tungsten, cobalt or lead may be employed. It may be the ball 158 has to be less dense than steel so a ceramic material, silicon nitride, alloys of titanium and aluminum or a hollow ball of any durable material may be used. In addition, a potential variable may be the size of the opening 162 which produces a different ratio between the area of the ball 158 that is exposed to pressure from above as contrasted to the area of the ball 158 that is exposed to pressure from below.

When the plunger 150 is pushing liquid upwardly in the production string 152, and pressure from below exceeds the hydrostatic load of liquid above the plunger 150, the plunger 150 maintains its upward direction and moves upwardly in the well 154 to unload liquid at the surface. This seems contradictory to the idea that the weight of the liquid above the piston 150 forces the ball 158 downwardly into sealing engagement with the seat 168. However, the pertinent question is what forces are acting on the ball 158. The upward force is the pressure from below multiplied by the area of the ball 158 exposed through the opening 162. The downward force is the pressure from above multiplied by the net upwardly facing area of the ball 158 which is largely controlled by the shape of the valve seat 168 as suggested in FIGS. 8-9 where the shape of the valve seat 168 exposes substantially the entire diameter of the ball 158 to pressure from above. If the valve seat 168 were of a typical frusto-conical shape, part of the area of the ball 158 above the seat 168 would be downwardly facing so the net upwardly facing area of the ball 158 would be much smaller and more nearly the area of the lower opening 162 and thus not so effective.

When the plunger 150 is pushing liquid upwardly in the production string 152, the ball 158 engages the valve seat 168 so the ball 158 is exposed to pressure through the opening 162. Because the opening 162 is smaller than the ball 158 and because pressure from above acts on the full diameter of the ball 158, the ball 158 closes the passage 160 so any liquid above the plunger 150 is pushed upwardly in the well.

So long as the net upwardly facing area of the ball 158 is significantly larger than the downwardly facing area of the ball 158 exposed through the opening 162, there exists a range of hydrostatic loads above the plunger 150 that is sufficient to keep the ball 158 sealed on the seat 168 while the differential pressure across the plunger 150 is sufficient to move the plunger 150 upwardly thereby carrying any liquid above the plunger 150 to the surface.

So long as forces created by pressure from below exceeds forces created by the liquid load above the plunger, the plunger 150 rises to the surface where it hits a stop (not shown) thereby bouncing the valve ball 158 off the valve seat 168. The plunger 150 immediately begins falling into the production string 152 because it is no longer sealed against the seat 168. It will accordingly be seen that the valve ball 158 is dislodged from its seat 168 in a manner different than the valve balls 18, 108.

If the plunger 150 contacts a sizeable quantity of liquid in the production string, operation is as described above. If the plunger 150 does not contact a quantity of liquid in the production string and, instead, falls completely to the bottom of the well 154 into a quantity of liquid, operation of the plunger 150 is essentially the same.

While the plunger 150 is falling in a stream of gas, the velocity of the gas is sufficient to raise the valve ball 158 away from the seat 168. It may seem counterintuitive that falling into a body of liquid should move the ball 158 downwardly when a similar event causes the valve balls 18, 108 to rise. When a falling plunger 150 meets a slug of liquid, the sleeve 156 and valve ball 158 slow down and the valve ball 158 bounces relative to the sleeve so the valve ball 158 at some time falls against the curved valve seat 168 thereby separating liquid above the plunger 150 from gas below the plunger 150. If, at any time, the valve ball 158 falls into the seat 168, the difference in area acting on the valve ball 158 from above and from below is sufficiently great to keep the ball 158 in the seat 168 for the same reasons that the plunger 150 operates to push a load of liquid upwardly from the bottom of the production string even though pressure from below is greater than pressure from above.

It will be seen that the valve ball 158 is the only moving element in the passage 114 that is operative, i.e. only the valve ball 108 modifies operation of the plunger 100 during its use.

The hydrocarbon wells 14, 54, 104, 154 include other accessories commonly used in conjunction with plungers. Typically, a stop is placed in the production string 12 at a selected location, such as near perforations in a vertical well. In a horizontal well, the stop may be placed in or near the heel of the well where the transition is made between vertical and horizontal. Some type spring may be set on the stop to cushion the fall of the plunger as it reaches the bottom of its maximum extent of travel. At a well head on the surface, some mechanism is provided to grasp the plunger as it reaches its upper limit of travel. A controller associated with the well head normally has the capability of controlling the time in which the plunger is held at the surface. Other similar accessories will be apparent to those skilled in the art. It will be apparent that the sleeves of the various embodiments of this invention may be made in multiple pieces that are connected together so the internal moving elements may be installed in a conventional manner.

The plungers 10, 50, 100, 150 disclosed herein are useful in conventional vertical wells or in horizontal wells. Although the operation of the plungers 10, 50, 100, 150 has been described in conjunction with gas wells that produce some liquid, the plungers are also useful in high ratio oil wells or in oil wells that are artificially lifted by gas lift. One of the peculiarities of gas lifted wells is that liquid flow is inherently in batches or slugs where the liquid slugs are separated by pockets of gas which provide the impetus to move the liquid slug toward the surface. Gas lift design and tweaking is more of an art form than a scientific or engineering exercise so it a particular design may not fit the conditions of a well as it exists originally. In addition, the volume of liquids and gases and their pressures, decline over time in hydrocarbon wells so that an initially perfect gas lift design will inherently be imperfect later.

Some horizontal wells include gas lift valves in the production string to artificially lift or assist in lifting liquids to the surface. One particular application of the embodiments disclosed herein is in gas lifted horizontal wells from shaley or very tight formations because such wells exhibit steep decline curves, meaning that the volume and pressure of produced fluids declines more-or-less significantly over time. In such situations, optimum gas lift designs and their requirements change significantly, meaning that actual production often differs significantly from the potential production of the formation. The ability of the disclosed plungers to automatically detect liquid pockets, when falling in gas in a well, has the opportunity to improve the production of gas lifted horizontal wells completed in rapidly declining reservoirs and thereby make the wells more commercial.

One peculiarity of incorporating the disclosed plungers in a gas lifted well, either vertical or horizontal, is the plunger almost always detects a liquid pocket and reverses direction before reaching the bottom of its maximum intended travel, i.e. the location of a stop. Thus, an unusual feature of the plungers 10, 50, 100, 150 is that normal operation in a gas lifted well is characterized by the plunger never falling far enough to contact a stop near the bottom of maximum intended travel. Thus, the plunger in such a well will normally cycle many times before falling to its lowermost maximum intended position. When the plunger in a gas lifted well does contact a stop, it means the formation has quit producing a substantial amount of liquid.

As heretofore described, the operation of the plungers has been related to contacting a liquid slug and, because of the force of contact or inertia, the valve in the plunger closes. The same end result can be accomplished using primarily buoyancy or buoyancy in combination with impact forces if the density of the valve ball 18, 108 can be selected to be between the density of gas and the density of an expected liquid such as a mixture of condensate and salt water. A variety of durable low density materials may be used but a preferred valve ball 18, 108 may comprise a hollow ball of durable material such as stainless steel or other suitable metal or metal alloy. For example, in the embodiment of FIGS. 6-7, the valve ball 108 may have a density in the range of 5-9 pounds/gallon which is much greater than the density of natural gas at any pressure and is below the density of salt water of the type produced by most wells. A preferred range may be from about 6-8 pounds/gallon which is lower than a normal mixture of condensate or oil (having a density of about 6 #/gallon) and salt water (having a density of about 9 #/gallon). In such an embodiment, when the plunger 100 falls into a batch of liquid, the valve ball 108 will rise until it seals against the valve seat 122 so that pressure from below will drive the plunger 100 and any liquid above it toward the surface.

In all of the above embodiments, it will be seen that the valve members and whatever causes the valve members to move between a position allowing flow through the passage during downward movement and a position restricting flow through the passage are located inside the passage through the sleeve. This makes for a much more robust plunger suitable for operation in oil and gas wells. It will also be seen that the valve balls 18, 108, 158 do not connect to any valve operator or any force applier. Specifically, the plungers are free of any springs, mechanical or pneumatic.

The valve balls 18, 108, 158 are capable of freely rotating in any direction about any axis and thereby present a different surface to their associated valve seat in successive cycles thereby providing a valve element of much greater durability than a valve ball which seats in only one orientation. In other words, the wear on the valve balls 18, 108, 158 is spread over their entire surfaces rather than being constrained to only one circle. Where the valve elements 18, 58, 108, 158 are of the density of metals, it will be seen that the forces acting on the valve elements 18, 58, 108, 158 during downward movement of the plunger may exclusively be gravity, differential pressures generated by fluids flowing through the plunger and impact forces generated by impact of the plungers into a contiguous body of liquid. Where the valve elements 18, 108 are of a density less than the density of liquid in the production string, buoyancy may also be included.

Figure 10:
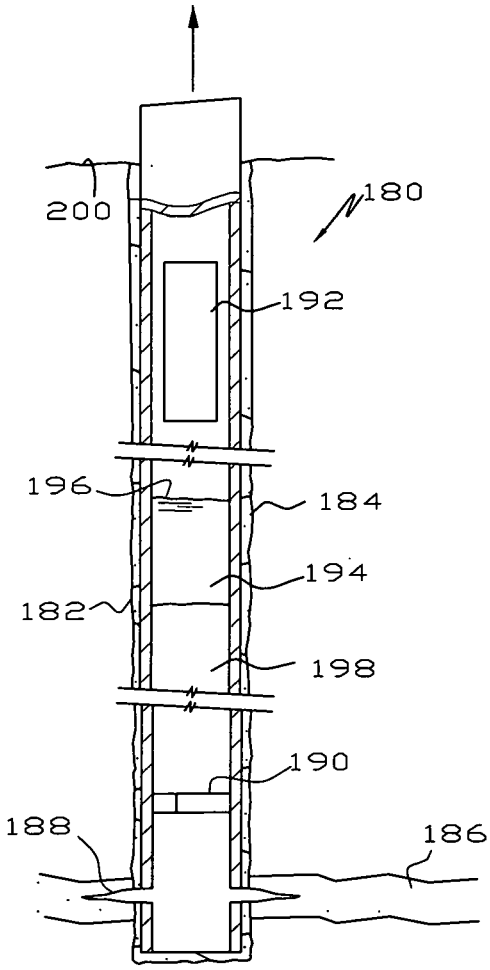
FIG. 10 is a schematic view of a vertical well suitable for plunger operation.

Referring to FIG. 10, a vertical hydrocarbon well 180 includes a production string 182 cemented in a well bore 184 and receiving a mixture of gas and liquid from a formation 186 through perforations 188. The production string 182 may be equipped with a tubing stop 190 and spring (not shown) to stop downward movement of a plunger 192. In operation with the disclosed plungers, a liquid slug 194 and its gas/liquid interface 196 is substantially above the tubing stop 190. The liquid slug 194 may be separated by a gas bubble 198 from the tubing stop 190 and perforations 188. When the plunger 192 reaches the liquid slug 194, it reverses direction from downward to upward and raises part of the liquid slug 194 to earth's surface 200 where gas and liquid are separated and handled in a conventional manner.

Figure 11:
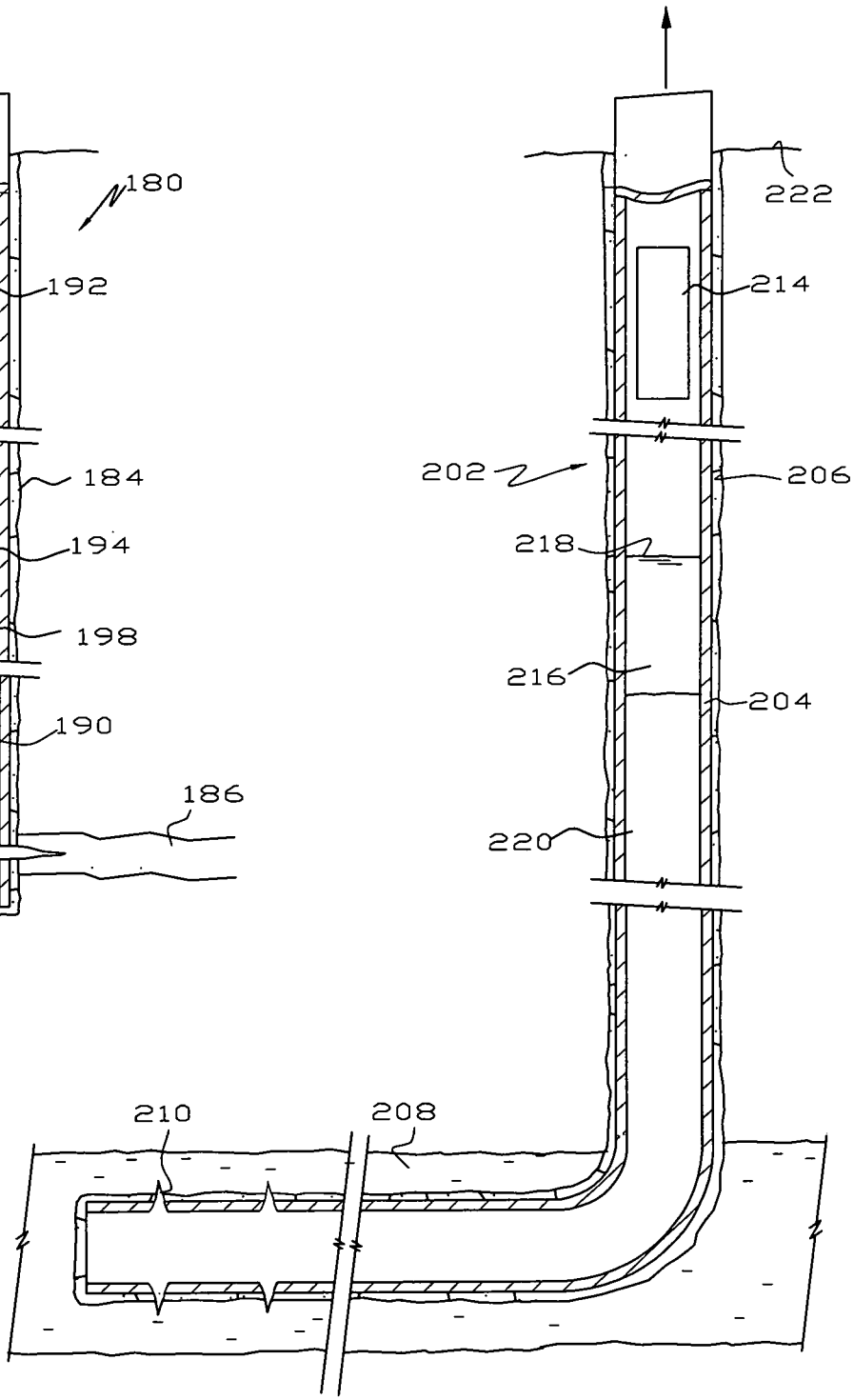
FIG. 11 is a schematic view of a horizontal well suitable for plunger operation.

Referring to FIG. 11, a horizontal hydrocarbon well 202 includes a production string 204 cemented in a well bore 206 and receiving a mixture of gas and liquid from a formation 208 through perforations 210. The production string 204 may or may not be equipped with a tubing stop (not shown) in the vertical leg of the well 202 to stop downward movement of a plunger 214. In operation with the disclosed plungers, a liquid slug 216 and its gas/liquid interface 218 are substantially above the tubing stop (not shown) and/or the horizontal leg of the well 202. The liquid slug 216 may be separated by a gas bubble 220 from the tubing stop 212 and perforations 210. When the plunger 214 reaches the liquid slug 216, it reverses direction from downward to upward and raises part of the liquid slug 216 to earth's surface 222 where gas and liquid are separated and handled in a conventional manner.

If a 50' long liquid slug appears a short distance above perforations, e.g. a hundred feet, it is difficult to say with certainty that the plungers disclosed actually reverse direction in response to contacting the gas/liquid interface. However, it is relatively easy to establish if a liquid slug is contacted half way to perforations and the plunger reverses course because the cycle time for the plunger to travel to the bottom of a particular well and return to the surface is something that experience and attention can establish. In other words, operation of the disclosed plungers in the manner disclosed is provable by observation of the cycle times of a plunger in a well where experience shows the duration of a complete travel of a plunger to and from a tubing stop.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the following claims.

We claim:

1. A method of operating a plunger for removing liquids from a production string of a hydrocarbon well, the Plunger having a sleeve providing a through passage allowing flow therethrough and a valve seat in the passage and an exterior configured to reduce leakage between the exterior of the sleeve and an interior of the production string and a valve member being configured to move into seating engagement with the valve seat in response to the sleeve contacting a body of liquid while falling in the production string, the valve member being free if any component below the sleeve, the method comprising:

dropping the sleeve with the valve member therein into the production string into an upwardly moving stream of reservoir gas and liquid;

maintaining the valve member entirely within the passage during upward and downward movement of the plunger in the hydrocarbon well, the valve member being movable between a first position allowing flow through the passage and a second position abutting the valve seat thereby restricting flow through the passage;

in response to impacting a liquid slug in the production string, moving the valve member from the first position to the second position and thereby reversing direction of the sleeve from downward to upward, and then pushing at least part of the liquid slug upwardly in the production string to earth's surface.

2. The method of claim 1 wherein the well produces a stream of gas having the slug of formation liquid therein below which is a gas bubble, the gas bubble separating the liquid slug from perforation in the well and the sleeve reverses direction upon contact with the formation liquid slug above the gas bubble.

3. The method of claim 1 wherein the hydrocarbon well includes a vertical leg and a generally horizontal leg and the production string includes a section in the leg and a section in the horizontal leg, the vertical and horizontal sections of the production string being free of a tubing stop.

4. The method of claim 1 wherein the perforations in the well are at a predetermined depth and the reversing step occurs at a location vertically separated from the perforations by a liquid slug.

5. The method of claim 4 wherein the location is vertically separated from the perforations by a liquid slug and a gas bubble.

6. A method of operating a plunger for removing liquids from a production string of a hydrocarbon well comprising maintaining a valve member entirely inside the plunger during upward and downward movement of the plunger in the well;

mounting the valve member for movement between a first position allowing flow through the plunger and a second position restricting flow through the plunger;

dropping the plunder with the valve member therein in the production string into an upwardly moving two phase stream of reservoir gas and liquid, moving reservoir gas and liquid through the plunger and placing the valve member in the first position;

in response to contacting a gas-liquid interface of a formation liquid slug in the production string, moving the valve member from the first position to the second position and reversing direction of the plunger from downward to upward, and then pushing at least part of the liquid slug upwardly in the production string to earth's surface.

7. The method of claim 6 wherein the liquid slug is at a gas/liquid interface in the production string and reversing direction of the plunger being in response to striking the liquid slug.

8. The method of claim 7 wherein the liquid slug is vertically separated from perforations by a gas bubble.

9. The method of claim 6 wherein the hydrocarbon well includes a vertical leg and a generally horizontal leg and the production string includes a section in the vertical leg and a section in the horizontal leg, the vertical and horizontal sections of the production string being free of a tubing stop.

10. The method of claim 6 wherein reversing direction of the sleeve occurs at a location intermediate ends of the production string.

11. A method of operating a plunger for removing liquids from a production string of a hydrocarbon well comprising;

captivating a valve member entirely inside the plunger during upward and downward movement of the plunger in the well;

mounting the valve member for movement between a first position allowing flow through the plunger and a second position restricting flow through the plunger;

dropping the plunger with the valve member therein in the production string into an upwardly moving stream of reservoir gas and liquid and placing the valve member in the first position thereby allowing flow through the plunger;

in response to contacting a liquid slug in the production string, moving the valve member from the first position to the second position and thereby restricting flow through the plunger and reversing direction of the plunger from downward to upward, and then pushing at least part of the liquid slug upwardly in the production string to earth's surface.

12. The method of claim 11 wherein the liquid slug is at a gas/liquid interface in the production string and reversing direction of the plunger being in response to striking the liquid slug.

13. The method of claim 11 wherein the liquid slug is vertically separated from perforations by a gas bubble.

14. The method of claim 11 wherein reversing direction of the sleeve occurs at a location intermediate ends of the production string.

15. A method of operating a plunger for removing liquids from a production string of a hydrocarbon well, the plunger having a sleeve providing a passage therethrough allowing flow through the plunger during downward movement of the plunger in the well and a valve member free of any component below the sleeve, the passage providing a valve seat, the method comprising:

dropping the plunger in the production string into an upwardly moving stream of reservoir gas and liquid while maintaining the valve member inside the plunger and allowing flow through the plunger;

in response to contacting a liquid slug in the production string, reversing direction of the plunger from downward to upward by moving the valve member into seating engagement with the valve seat, and then pushing at least part of the liquid slug upwardly in the production string to earth's surface.

16. The method of claim 15 wherein the plunger reaches the liquid slug intermediate the ends of the production string.

17. The method of claim 15 wherein the liquid slug is at a gas/liquid interface in the production string and reversing direction of the plunger being in response to striking the liquid slug.

18. The method of claim 17 wherein the liquid slug is vertically separated from perforations in the well by a gas bubble.

19. The method of claim 15 wherein the production string includes a tubing stop and the reversing step occurs above the tubing stop.

20. A method of operating a plunger for removing liquids from a production string of a hydrocarbon well producing a stream of gas having a slug of formation liquid below which is a gas bubble, the gas bubble separating the liquid slug from perforations in the well, the only material below the formation liquid being formation contents, comprising:

dropping the plunger in the production string into an upwardly moving stream of reservoir gas and liquid while maintaining a valve member inside the plunger and allowing flow through the plunger;

in response to impacting the liquid slug in the production string, seating the valve member in the plunger and reversing direction of the plunger from downward to upward, impacting the liquid slug being the only cause of reversing direction, and then pushing at least part of the liquid slug upwardly in the production string to earth's surface.

21. The method of claim 20 further comprising maintaining one, and only one, plunger in the production string at a time.

* * * * *